United States Patent [19]

Holley

[11] Patent Number: 4,940,001

[45] Date of Patent: Jul. 10, 1990

[54] RAIL SPIKE CLEANING APPARATUS

[75] Inventor: John D. Holley, Montgomery, Ala.

[73] Assignee: Holley Engineering Company, Inc., Montgomery, Ala.

[21] Appl. No.: 269,074

[22] Filed: Nov. 9, 1988

[51] Int. Cl.[5] ..... E01B 29/32

[52] U.S. Cl. ..... 104/307; 15/3.2; 51/164.1; 209/257

[58] Field of Search ..... 104/2, 17.1, 307; 15/3.13, 3.2; 51/163.1, 164.1; 209/240, 241, 247, 255, 257, 284

[56] References Cited

U.S. PATENT DOCUMENTS

| | | | |
|---|---|---|---|
| 1,467,348 | 9/1923 | Young | 209/257 X |
| 1,835,219 | 12/1931 | Hopkins | 51/164.1 X |
| 3,680,799 | 8/1972 | Hallerback | 51/164.1 X |
| 4,263,797 | 4/1981 | Cooper | 104/307 X |
| 4,399,029 | 8/1983 | Clin et al. | 209/257 X |
| 4,478,152 | 10/1984 | Holley | 104/307 X |
| 4,493,767 | 1/1985 | Monteyne | 209/257 X |

FOREIGN PATENT DOCUMENTS

| | | | |
|---|---|---|---|
| 139005 | 3/1949 | Australia | 51/164 |

*Primary Examiner*—Margaret A. Focarino
*Assistant Examiner*—Gary C. Hoge
*Attorney, Agent, or Firm*—Kerkam, Stowell, Kondracki & Clarke

[57] ABSTRACT

A rail spike cleaning apparatus includes a tumbler and an arrangement whereby the tumbler is automatically loaded and unloaded. The tumbler is a continuous tumbler in that it is operable to receive spikes continuously while it is tumbling and operable to automatically discharge cleaned spikes while it is tumbling. The tumbler is connected to a motor which causes the tumbler to rotate about a rotation axis, which is preferably horizontal. The tumbler is cylindrical and the axis of rotation is the center axis of the cylinder. The tumbler includes a cleaning chamber separated from a discharge chamber by a wall. When spikes reach sufficient height in the cleaning chamber, they may overflow the wall and go into the discharge chamber. Spikes which land in the discharge chamber are caught by vanes which carry them up to drop upon a conveyor belt whereupon they are carried out of the tumbler. The arrangement to automatically carry the spikes into the tumbler includes the same conveyor belt which extends completely through the tumbler. The conveyor belt is attached to a magnetic wheel which picks up spikes from a feed bin and carries them up for traveling along the conveyor into the cleaning chamber of the tumbler. A plow is used to channel spikes off of the conveyor into the cleaning chamber. A rubber liner is used in the cleaning chamber to promote tumbling action and to lessen the noise.

38 Claims, 5 Drawing Sheets

10
14
20
22
24
25
26
28
34T
34N
35
36
42
44
46
48
50
54
58
60
62
64
64H
66
66S
68
70U
70L
72
74
74L
74U
80
82
82A
82B
100
102
104
106
107
2B
3
4

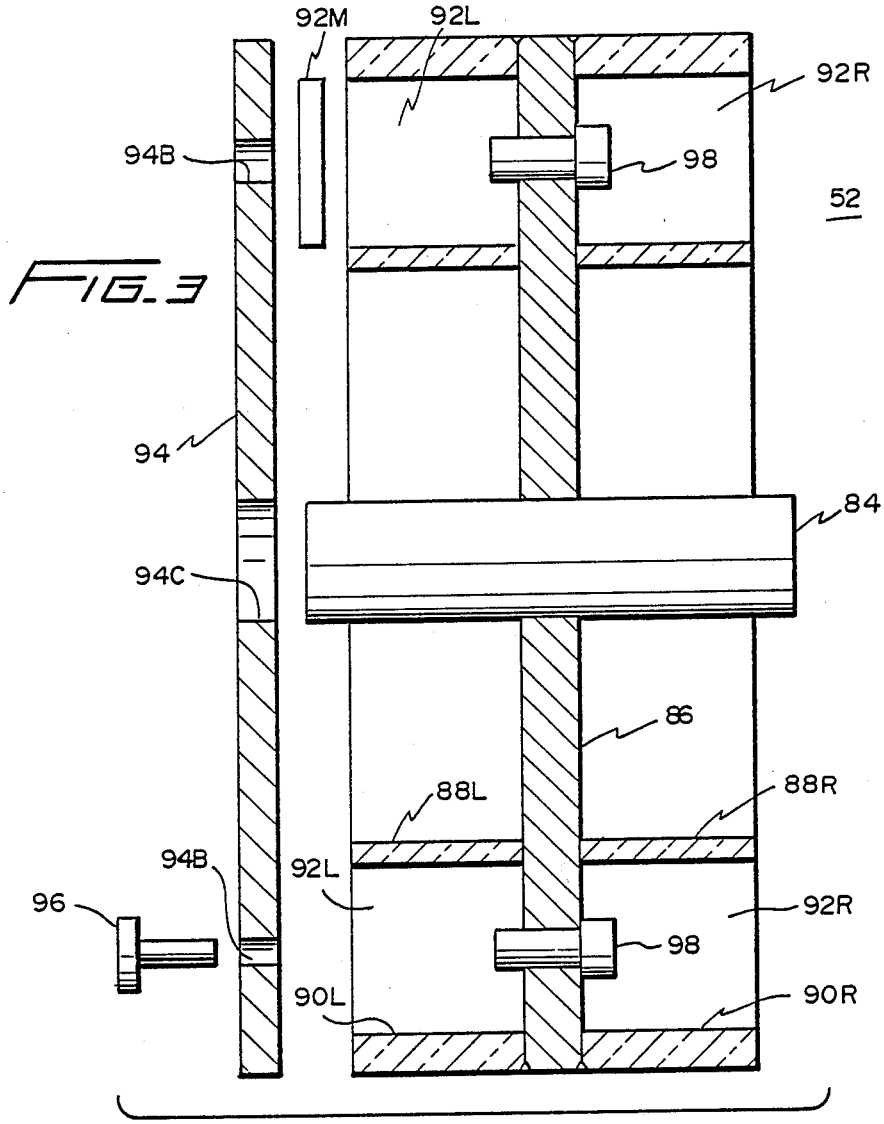
FIG. 3
FIG. 4
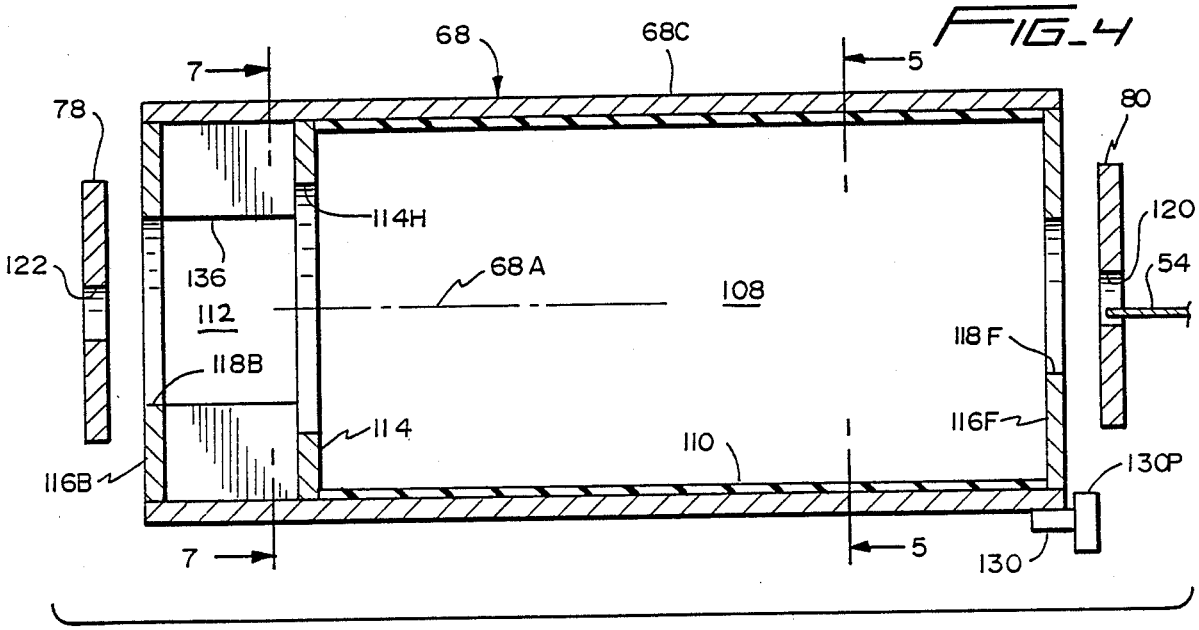

FIG. 7
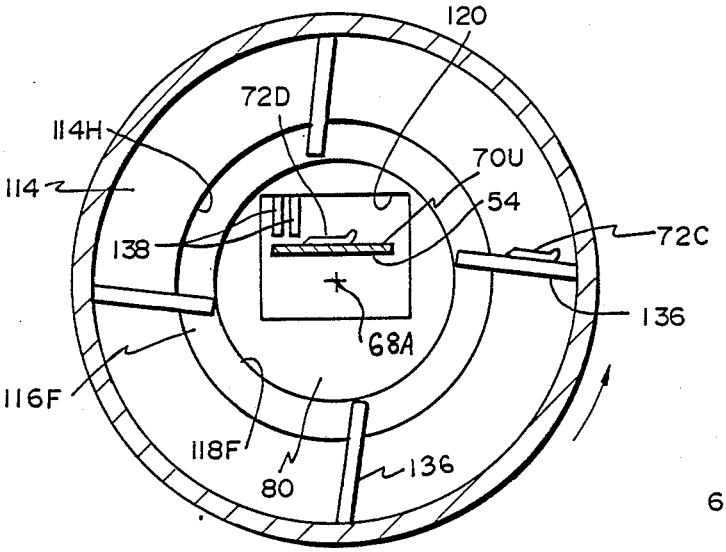
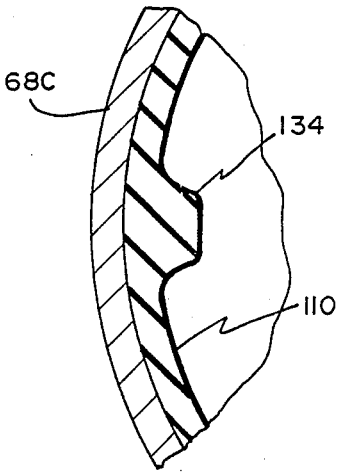
FIG. 6
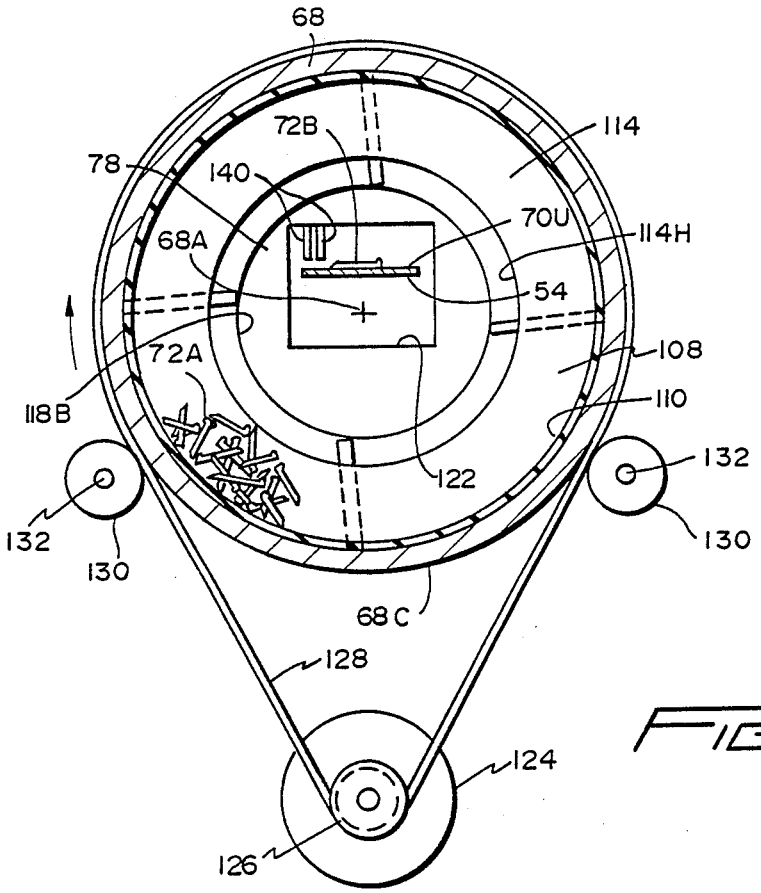
FIG. 5

RAIL SPIKE CLEANING APPARATUS

BACKGROUND OF THE INVENTION

This invention relates to a spike reclaiming machine for preparing railroad spikes for reuse. More specifically, it relates to a rail spike cleaning apparatus.

The use of spikes to stabilize rails on a railroad track is well known. Such spikes are used to hold tie plates in position on the railroad ties on the bed of the railroad track.

After a railroad track has been used sufficiently, components of the track begin to wear out. Accordingly, it is necessary to occasionally pull out the spikes holding the tie plates to the ties for repair or maintenance purposes.

As part of the repair or maintenance process, various machines have been use to reclaim spikes and/or tie plates so that they may be reused. For example, the present inventor's prior U.S. Pat. 4,225,429 issued on September 30, 1980 entitled "VEHICLE FOR CLEANING RAILWAY ROADBEDS OF MAGNETIC ARTICLES" shows an arrangement using a magnetic wheel in combination with a conveyor belt in order to pick up magnetic articles from a railway roadbed. The present inventor's prior U.S. Pat. 4,478,152 issued on October 23, 1984 entitled "RAILROAD SCRAP PICKUP MACHINE" discloses an arrangement for picking up magnetic articles from a railway roadbed. The arrangement uses a magnetic wheel connected to a stripper tray for depositing the magnetic articles upon a conveyor belt. These two prior patents are hereby incorporated by reference.

The use of batch-type tumblers in order to clean spikes or other articles reclaimed as part of a rail maintenance or improvement project involving so-called "tie gangs" is well known. Such tie gangs include a series of different machines which are used as part of an overall process of replacing damaged ties. The tumblers have previously been used to clean off the spikes by placing them in a rotatable drum or other container which then rotates in such a way as to cause them to have tumbling action. The spikes are loaded in a batch into the tumbler and are removed after halting of the tumbling action following a sufficient period of tumbling so as to clean off the spikes.

After the cleaning of the spikes, the spikes are generally inspected and sorted into spikes which are suitable for reuse and those spikes which are in such poor condition that they are discarded or used for scrap metal.

Although prior techniques have been generally useful at reclaiming spikes, they have been subject to a number of disadvantages. In particular, the loading and unloading of the batch tumblers is a time consuming process. Further, various prior techniques for reclaiming spikes have been quite labor-intensive such that the reclaiming of the spikes is not as economical as would be the case if reclaiming could be performed without requiring as much worker time. Other factors such as the use of different machines for picking up the spikes and for cleaning the spikes have also contributed to the cost associated with the reclamation process.

OBJECTS AND SUMMARY OF THE INVENTION

Accordingly, it is a primary object of the present invention to provide a new and improved spike cleaning apparatus.

A more specific object of the present invention is to provide a spike cleaning apparatus which is relatively economical.

A further object of the present invention is to provide a spike cleaning apparatus which can automatically pick up spikes from the roadbed and clean the spikes without requiring any worker to handle the spikes or take any steps in between the picking up and the cleaning steps.

A still further object of the present invention is to provide a cleaning apparatus which provides for the automatic discharge of spikes from a continuous tumbler after the spikes have been cleaned.

Yet another object of the present invention is to provide a spike cleaning apparatus which may operate in a mode whereby a tumbler is bypassed if the operator determines that substantially all of the spikes are in such poor condition that reuse of the spikes is not desirable.

Yet another object of the present invention is to provide a spike cleaning apparatus having a continuous tumbler, meaning that it can be loaded and unloaded while it is tumbling.

The above and other objects of the present invention which will become more apparent as the description proceeds are realized by a spike cleaning apparatus with a tumbler having a cleaning chamber therein. A motor means is operatively connected to move the tumbler for cleaning spikes by tumbling action of spikes within the cleaning chamber. A vehicle frame has rail engaging wheels and is operable to move along a railroad track, the tumbler being mounted to the vehicle frame. The tumbler is a continuous tumbler operable to receive spikes continuously while it is tumbling and operable to automatically discharge cleaned spikes while it is tumbling. The spike cleaning apparatus further includes a conveyor extending from outside the tumbler to within the tumbler. A remover is operable to remove spikes from the conveyor and cause the spikes to enter the cleaning chamber for cleaning therein. The apparatus is operable to automatically remove spikes from the tumbler by way of the conveyor after cleaning of the spikes. The conveyor carries spikes into the tumbler via an entrance port and out of the tumbler via an exit port. The exit port and entrance port are on opposite ends of the tumbler. The remover is a plow which is disposable in a plowing position to cause spikes to drop off of the conveyor to be cleaned in the cleaning chamber. The plow is movable out of the plowing position such that spikes may travel directly through the tumbler without cleaning. A discharge chamber is adjacent the exit port, the discharge chamber having at least one vane disposed therein and operable to carry spikes up to a point where the spikes fall onto the conveyor for removal from the tumbler. The discharge chamber receives spikes from the cleaning chamber after the spikes in the cleaning chamber have reached a sufficient amount or magnitude to overcome a barrier separating the cleaning chamber and the discharge chamber. Input means are provided to automatically pick up spikes from a rail bed and automatically feed the spikes into the tumbler. The input means includes a pick up magnetic wheel, an input bin, a feed magnetic wheel, and a portion of the conveyor belt. The pick up magnetic wheel picks up the spikes from the road bed and supplies them to the input bin, whereupon the feed magnetic wheel feeds the spikes to the conveyor belt, a portion of which extends around the feed magnetic wheel. The cleaning chamber has a rubber liner disposed therein, the rubber liner having inwardly projecting portions to promote tumbling. The tumbler rotates 360° about an axis which is within 30° of horizontal.

The invention may alternately be described as a spike cleaning apparatus having a tumbler with a cleaning chamber and a discharge chamber at least partially separated by a wall from the cleaning chamber. The tumbler has an entrance port for passage of spikes into the cleaning chamber and an exit port for passage of spikes out of the discharge port. A motor means operates the tumbler for cleaning the spikes. The tumbler is operable to automatically cause spikes to move from the cleaning chamber into the discharge chamber after the spikes have been cleaned. The spikes move from the cleaning chamber to the discharge chamber upon reaching a sufficient magnitude to pass over the wall. Discharge means is operable to discharge spikes from the discharge chamber during continuous tumbling of other spikes in the cleaning chamber. The discharge means includes at least one vane disposed in the discharge chamber and operable to carry spikes upward. The discharge means includes means to receive spikes falling loose from the vane and to cause spikes to leave the tumbler. The means to receive spikes is a conveyor belt.

The invention may alternately be described as a spike cleaning apparatus comprising a tumbler having a cleaning chamber therein and a motor means for operating the tumbler to clean spikes. A conveyor extends from outside the tumbler to within the tumbler. A remover is operable to remove spikes from the conveyor and cause the spikes to enter the cleaning chamber for cleaning therein. The apparatus is operable to automatically remove spikes from the tumbler by way of the conveyor after cleaning of the spikes. The conveyor is a conveyor belt operable to carry spikes into the tumbler via an entrance port and out of the tumbler via an exit port.

BRIEF DESCRIPTION OF THE DRAWINGS

The above and other features of the present invention will be more readily understood when the following detailed description is considered in conjunction with the accompanying drawings wherein like characters represent like parts throughout the several views and in which:

FIG. 3 shows a conveyor or feed magnetic wheel arrangement in side cross-section and with parts exploded;

FIG. 4 shows a cross-section side view of the tumbler along lines 4—4 of FIG. 2;

FIG. 5 shows an end view with portions in cross-section of the tumbler and is a cross-section taken along lines 5—5 of FIG. 4;

FIG. 6 shows an enlarged cross-section of a portion of the tumbler wall;

FIG. 7 shows an end view of portions of the tumbler with portions in cross-section and taken along lines 7—7 of FIG. 4;

DETAILED DESCRIPTION

Figure 1:
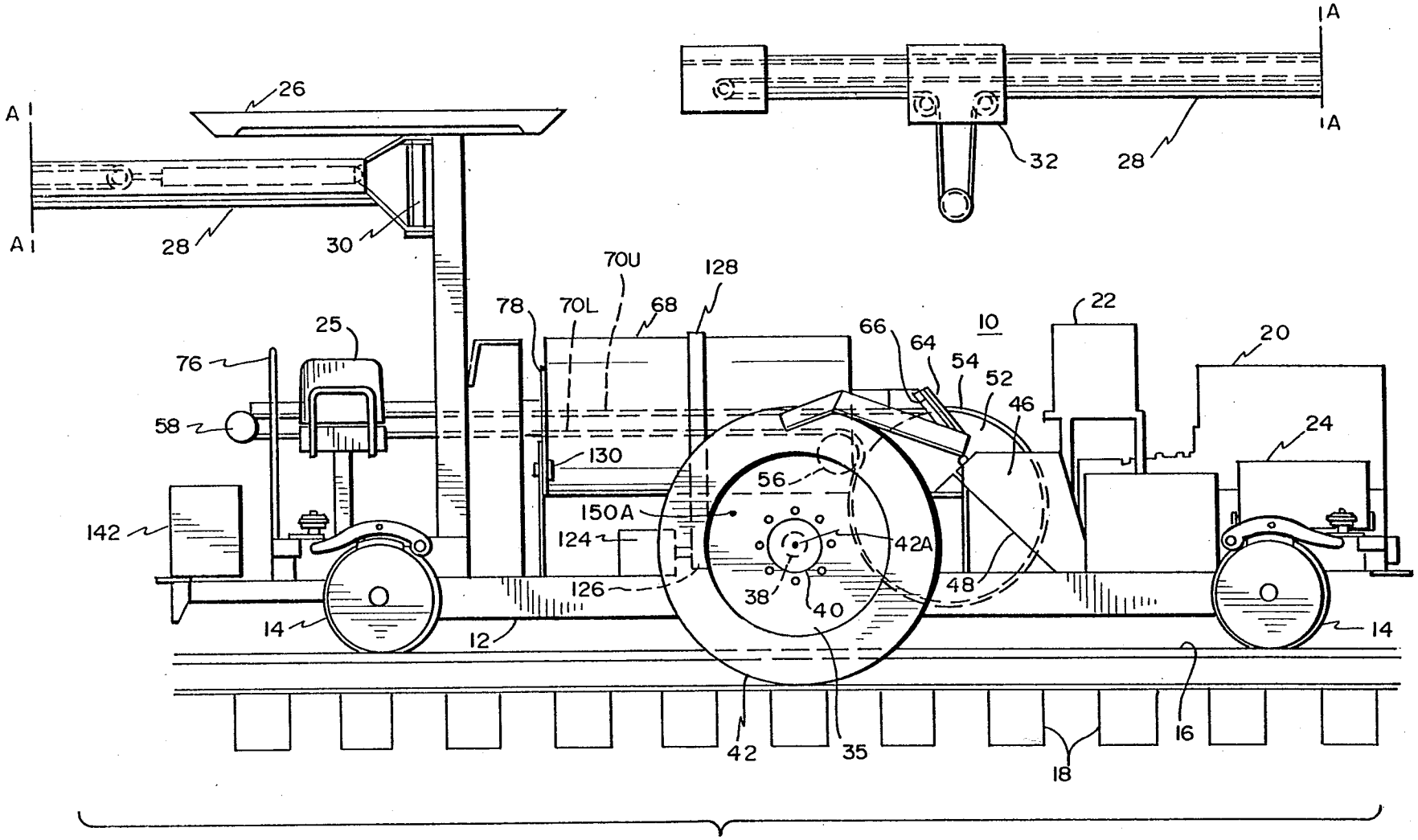
FIG. 1 shows a simplified side view of the present invention.
Figures 2, 2A, 2B, 2C:
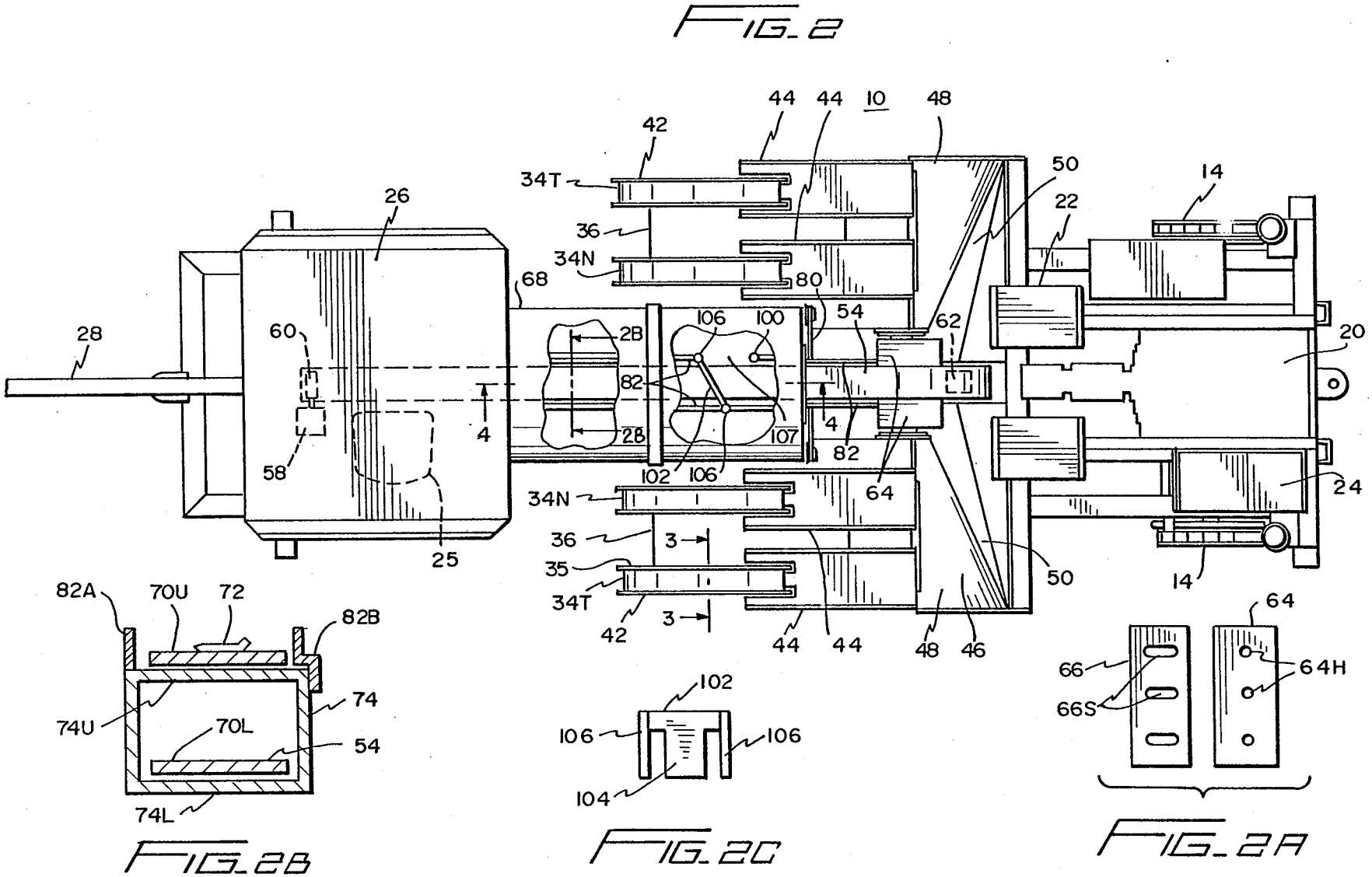
FIG. 2 shows a simplified top view of the present invention.
FIG. 2A shows a planar view of a wiper structure of the machine.
FIG. 2B shows a simplified cross-section taken along lines of 2B—2B of FIG. 2.
FIG. 2C shows a plow used with the present invention.

With reference now to FIGS. 1 and 2, the spike cleaning machine 10 of the present invention will be discussed in detail. The machine 10 includes a frame 12 and four rail engaging wheels 14 (not all of the wheels are visible) which are used to convey the machine down rails 16 (only one rail 16 shown in FIG. 1) on top of ties 18. For ease of illustration, the tie plates and spikes are not shown in FIGS. 1 and 2. A power plant 20, hydraulic fluid tank 22, and fuel tank 24 may be used to provide power to the wheels 14 at the front of the machine 10. The front of the machine 10 is at the location of the power plant 20 as the machine would generally move from left to right during operation. As various standard arrangements are used in order for the power plant 20 to supply hydraulic fluid under pressure which is used to propel the front pair of wheels 14, the details of the vehicle propulsion system need not be discussed herein.

At the back of the machine 10 is an operator seat 25 covered by a roof 26. An optional crane 28 may be used for removing spikes from the machine 10. The crane 28, which has been arbitrarily divided at lines A—A in FIG. 1 to avoid making FIG. 1 too long, may pivot about a vertical axis corresponding to pin 30 and include a dolly 32 movable along the length of the crane 28 and having a gripping arrangement (now shown) for holding kegs (barrels) filled with spikes. As the crane 28 itself is not a necessary part of the present invention, it need not be discussed in further detail.

The machine 10 has magnetic wheels 34T and 34N which ride along the rail bed and pick up spikes. Each of the outer magnetic wheels 34T is positioned to ride outside of the rails (i.e., on the field side), whereas each of the inner magnetic wheels 34N is designed to pick up spikes on the gauge side or in between the two rails. Each of the magnetic wheels 34T is connected to a corresponding inner magnetic wheel 34N by a cylindrical member 36. The magnetic wheels 34T and 34N include permanent magnets (not separately shown) disposed therein and are constructed substantially identically to the inner and outer magnetic wheels 222T and 222N shown in FIG. 6 of the incorporated by reference U.S. Pat. No. 4,478,152. A hydraulic motor 38 and gear 40 (shown in FIG. 1 only) are used to power each of the inner and outer magnetic wheels 34N and 34T. Preferably there would be one of the motors 38 and one gear box 40 for each magnetic wheel assembly 42, which assembly comprises one of the outer magnetic wheels 34T, its corresponding inner magnetic wheel 34N and the cylindrical connecting piece 36. A cylindrical disk 35 is constructed like the member 276 in FIG. 6 of the U.S. Pat. No. 4,478,152.

Figure 8:
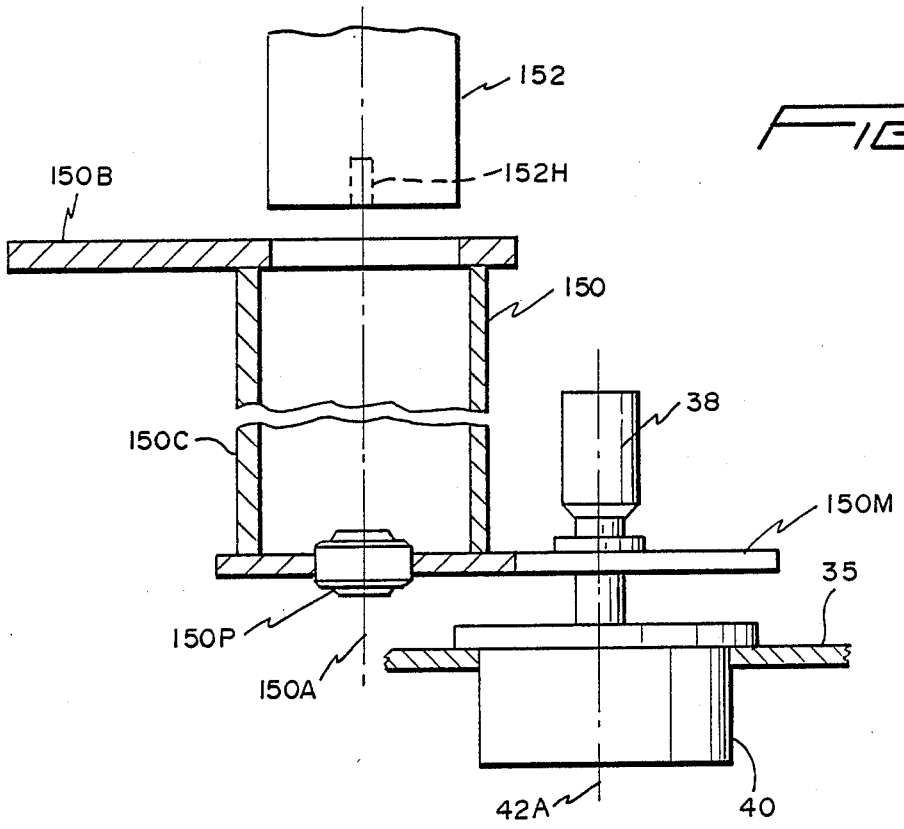
FIG. 8 is a simplified top view of portions of the machine showing how the pick up magnet is mounted.
Figure 9:
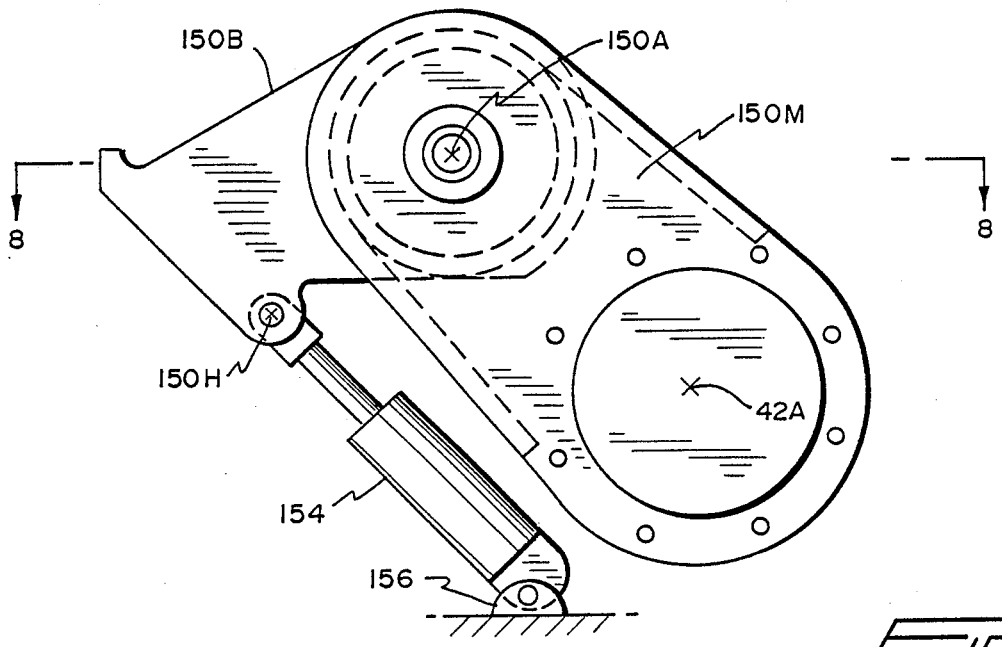
FIG. 9 is a simplified side view corresponding to parts of FIG. 8.

Considering FIG. 1 in conjunction with FIGS. 8 and 9, the mounting of the magnetic wheel assemblies 42 will be discussed. (Only the mounting for the right side assembly 42 is shown in FIGS. 8 and 9, but the left side assembly 42 would be mounted identically.) For ease of illustration, some parts have been left out of FIGS. 8 and 9. As best shown in FIG. 8, a member 150 includes a cylinder portion 150C which rotatably mounts upon the end of shaft 152. The shaft 152 (not completely shown) extends across the frame 12 and mounts the member 150 at one end and a similar member (not shown) at the other end, each of the members such as 150 corresponding to the magnetic wheel assembly 42 on one side of the vehicle. A bolt, not shown, may be used in combination with coupler 150P and hole 152H to prevent the member 150 from slipping off the end of mounting shaft 152. The member 150 includes a mounting plate 150M to which the motor 38 and gear box 40 are secured. The mounting plate 150M mounts the magnetic wheel assembly 42, while allowing disk 35 and the magnetic wheels themselves to rotate about axis 42A which is the central axis of the magnetic wheels and of the magnetic wheel assembly 42. The member 150 includes a back plate 150B having a hole 150H disposed therein. The hole 150H is connected to one end of a hydraulic cylinder 154, the other end of which is secured to the frame 12 by way of member 156 (depicted schematically in FIG. 9). When the hyrdraulic cylinder is in a normal position, the axis 42A will be disposed such that the magnetic wheels 34N and 34T (not shown in FIGS. 8 and 9) ride along the road bed picking up spikes. When it is desired to quickly move the machine 10 along the rail without picking up spikes, the hydraulic cylinder 154 is retracted such that member 150 rotates about axis 150A. This in turn lifts the magnetic wheel assembly 42 off the road bed.

Although the hydraulic cylinder 154 has been shown as retracting in order to lift the magnetic wheel assembly 42, various alternate arrangements are of course possible. It should be noted that the hydraulic cylinder 154 would be placed in a so called "float condition when the magnetic wheel is lowered to the ground for spike pick up activity. It should also be noted that raising the magnetic wheel assembly 42 is made by way of the hydraulic cylinder 154, but it is also advantageous to have a latch arrangement to lock the magnetic wheel assembly 42 in an upper position. Such latching arrangements are relatively common and need not be described in detail, but briefly may consist of a locking pin to lock the member 150 and/or the magnetic wheel assembly 42 in such a position that the magnetic wheels are held off and above the road bed. Various other locking arrangements could be used, but such latching or locking arrangements are not central to the present invention. It should also be noted that when the magnetic wheel assembly is riding along the ground and the hydraulic cylinder 154 is in its float position, the magnetic wheels may pivot about the axis 150A in order to minimize transmission of vibrations from the magnetic wheels through to the frame of the vehicle.

Referring back to FIGS. 1 and 2, each of the magnetic wheels 34T and 34N has a corresponding stripper tray 44 shaped as shown to strip spikes from the magnetic wheels 34T and 34N. The stripper trays 44 operate in the same manner as the stripper trays in the incorporated by reference U.S. Pat No. 4,478,152. Spikes which are picked up by the magnetic wheels are deposited upon the stripper trays 44.

After the spikes have been picked up from the railroad bed by the magnetic wheels 34T and 34N and deposited upon the stripper trays 44, they will slide off the stripper trays 44 into a chute or input bin 46. The input bin 46 has identical right and left halves, each of which includes a frontwardly inclined panel 48 such that spikes slide towards a panel 50 which is inclined towards the center of the bin 48, this also corresponding to the center of the machine 10.

By having the bin 46 shaped such that the spikes deposited by the stripper trays 44 will automatically slide towards the center of the bin 50, the spikes may be picked up by the magnets of a conveyor or tumbler feed magnetic wheel 52. A conveyor belt 54 extends around the magnetic wheel 52. As best shown in FIG. 1, the conveyor belt 54 extends around an idler 56 and past the operator seat 25 down to a drive motor 58 which powers a drive wheel 60 (FIG. 2 only) which causes the conveyor 54 to move in a path between the input bin 46 and the roller or wheel 60.

As shown in phantom line in FIG. 2 only, the bottom of the bin 46 may include a hole 62. The bottom of the magnetic wheel 54 would be just above the hole 62, the wheel 52 being sufficiently close to the bottom of the bin 46 that no spikes may slide out the hole 62. On the other hand, dust and other non-magnetic debris may slide out of the hole 62.

The magnetic wheel 52 is driven by conveyor belt 54 and picks up the spikes from the bin 46 and carries them up and around towards a pair of wiper plates 64 (which wipe any spikes off the sides of the magnetic wheel 52 so that they land on the conveyor 54). As best shown in FIG. 1, the conveyor 54 extends most of the way around wheel 52. In particular, the conveyor 54 extends horizontally from the top of the wheel 52 and extends down and around the wheel 52 up to the idler 56. Momentarily referring to FIG. 2A, each of the wiper plates 64 is preferably made of plastic and includes several holes 64H which allow mounting of it upon a metal support plate 66 which is secured to the frame 12 of the machine 10. The plastic wiper plates 64 are secured to the corresponding metal plates 66 by having a bolt (not shown) extend through the holes 64H into slots 66S within the metal plate 66. (For ease of illustration, the holes 64H are not shown in FIG. 2.) The slots 66S allow the plastic wiper plates 64 to be moved toward or away from the magnetic wheel 52 and conveyor 54 so as to optimize their action in wiping spikes off the side of the wheel 52 and causing the spikes to be carried by the conveyor 54. Additionally, the arrangement of bolting the plastic plates 64 allows one to easily replace the plates should they become worn.

The spikes which are deposited upon the conveyor 54 will be carried into a tumbler 68 for cleaning.

Before discussing the cleaning operation within the tumbler 68, it may be useful to discuss the structure of magnetic wheel 52 with reference to FIG. 3. As shown, the feed magnetic wheel 52 includes a central shaft 84, a circular pole piece 86 made of mild steel, left and right inner rings 88R and 88L made of stainless steel, left and right outer rings 90R and 90L made of stainless steel. Between the right inner and outer rings and the left inner and outer rings are corresponding right annular spaces 92R and 92L. The spaces 92L and 92R would hold a series of block magnets such as magnetic block 92M (only one shown). If desired, the various magnets could be grouped together in similar fashion to the arrangements shown in the incorporated by reference patents. The pieces 84, 86, 88R, 88L, 90R, and 90L are welded together to move as a unit. After placement of magnets such as 92M within the spaces 92L and 92R, a cover plate 94 is placed over each side of the magnetic wheel 52. For ease of illustration, only one such cover plate is shown in FIG. 3. The cover plate includes a center hole 94C through which the shaft 84 may extend and several radially spaced bolt holes 94B such that bolts 96 (only one shown) may extend through the bolt holes to attach the cover 94 to the assembly by way of a plurality of coupling nuts 98 disposed radially in the piece 86. Although the circular cover piece 94 has been shown as about the same diameter as the outer diameter of the outer rings 90R and 90L, the cover pieces (only one of which is shown) could alternately have a slightly greater diameter. The cover pieces 94 will be made of mild steel to serve as pole pieces for the blocks of magnets which would be packed within the zones 92L and 92R in similar fashion to the blocks of magnets shown in FIG. 6 of the U.S. Pat. No. 4,478,152.

Although not specifically shown, the conveyor belt 54 may include a series of cleats on its surface so as to help in conveying spikes by way of the conveyor.

With reference now to FIG. 2B, which is a cross-section taken along lines 2B of FIG. 2, the conveyor 54 includes an upper run 70U and a lower run 70L. As shown in FIG. 2B spikes 72 may be carried by the conveyor's upper run. A conveyor support tube 74 extends lengthwise substantially along the length of the conveyor 54 and includes an upper portion 74U and a lower portion 74L to respectively support the upper run 70U and the lower run 70L. The lower portion 74L may have a front end which is slightly behind (i.e., closer to operator seat 25) the front of the tumbler 68 such that the lower run 70L of conveyor 54 may turn down around the idler 56 as best shown in FIG. 1. Alternately, the lower support 74L might simply have a slot (not shown) disposed therein so that the lower run could curve around and in between the idler 56 and the magnetic wheel 52. More generally, the support tube 74 supports the conveyor 54 from shortly after the place where the conveyor 54 leaves the magnetic wheel 52 down to the back end of the conveyor adjacent motor 58. The previously discussed motor 58 may be mounted to the side of the support tube 74. The support tube 74 would be supported or mounted to the frame 12 by way of vertically extending members. For example, the support tube 74 could be bolted or otherwise mounted to vertical member 76 and vertical tumbler back end plate 78 in FIG. 1 and/or vertical tumbler front end plate 80 in FIG. 2. The end plates 78 and 80, which will be discussed in detail below, may simply be used to define entrance and exit ports for the tumbler 68 or may be used to support the tube 74. The tube 74 may include siderails such as 82A or 82B. In practice, the siderails on both sides would be identical, but siderails 82A and 82B show alternate constructions which might be used. A further alternative would have the planar siderail secured to the side, instead of the top, of the support tube 74. With any of the designs, the siderails would be used to generally maintain spikes on the conveyor 54. The siderails would be bolted, welded, or otherwise attached to the support tube 74. The siderails are more generally shown as 82 in FIG. 2.

As best shown in FIG. 2, the siderails 82 (structured like 82A, 82B, or similar siderail to hold spikes 72 on the conveyor 54) have a mount hole or tube 100 disposed thereon. The mount hole 100, which ideally would be close to where the conveyor 54 enters tumbler 68, is used to hold a plow 102 when it is in an inoperative position. The plow 102, shown in more detail in FIG. 2C, includes a center portion 104, and two side portions 106. The side portions 106 may fit within holes similar to hole 100 when the plow 102 is in its operative position as shown in FIG. 2. That is, the tubular portions 106 extend down into holes mounted on the siderails 82. When the tubular portions 106 are mounted in the corresponding holes (not separately visible in FIG. 2 because they are directly beneath the portions 106), the center portion 104 extends downward to the conveyor 54 and serves to block spikes from proceeding along the conveyor. Instead, the spikes are channeled off of the conveyor belt in the gap 107 between the mounting hole or tube 100 and the adjacent or same side hole corresponding to tube 106. The three holes provide flexibility in that the operator may realign the plow 102 such that it extends parallel to the siderail 82 and closes the gap in the siderail adjacent hole 100. In that case, spikes would simply go right through the tumblers 68 without being subjected to the cleaning action. This might be useful in a situation where the operator has determined that so few spikes are suitable for reuse that the cleaning process is unnecessary. In that case, the operator simply realigns the plow 102 moving it from its operable position where it causes spikes to fall into the tumbler to its inoperable position wherein it allows spikes to proceed directly through the tumbler. The plow 102 in a sense acts like a door which channels spikes into the tumbler in the position shown in FIG. 2 and, by rotating the door closed, it closes off the gap 107 in the siderail. Note that the holes such as hole 100 might be holes in the siderail or alternately they could be cylindrical support tubes mounted either in line or just outside of the siderails 82. Although the discussion has assumed that the portions 106 of plow 102 are generally cylindrical, other shapes could be used. Although the design of plow 102 as shown in FIG. 2C shows the center portion 104 to be the length as the mounting portions 106, the center portion 104 could be of a different length (height in FIG. 2C) such that when the plow 102 is in its operative or plowing position the bottom center portion 104 is immediately above the upper run of the conveyor.

With reference now to FIG. 4, the structure of the tumbler 68 will be discussed in detail. The tumbler 68 includes a cleaning chamber 108 located at the front end of the tumbler 68. The cleaning chamber 108 includes a rubber (or other resilient material) liner 110 and is separated from a discharge chamber 112 by a separation wall 114. The separation wall 114 is a circular plate or disk having a central hole 114H disposed therein which is concentric about the axis 68A. The axis 68A is the central axis of symmetry of the cylinder 68C which comprises the outer shell of tumbler 68. Additionally, the horizontal axis 68A is the axis about which the tumbler 68 rotates.

The ends of the tumbler 68 are closed off generally by walls 116F and 116B, each of which has a corresponding circular hole 118F and 118B disposed therein. The front and back plates 80 and 78 are shown in very simplified form in FIG. 4. Basically, these plates 80 and 78 are used to narrow down the holes 118F and 118B such that there is an entrance port 120 and an exit port 122 sufficient to accommodate the conveyor 54 and its support tube 74 (refer back momentarily to FIG. 2B). For ease of illustration, FIG. 4 has simply depicted a portion of the conveyor belt 54. The end plates 78 and 80 would be stationary relative to the frame 12 of the vehicle and fixed to the frame, whereas the end walls 116F and 116B would of course be rotating with the tumbler 68 in a manner described in detail below. Although the end plates 78 and 80 are shown as being planar and outside of the end walls 116F and 116B, they alternately might include cylindrical portions projecting towards the center of the tumbler, the cylindrical projecting portions essentially filling the holes 118F and 118B, but without contacting the end walls 116F and 116B. Such an arrangement will help to minimize the escape of dust from the tumbling which is occurring within the cleaning chamber 108.

Continuing to view FIG. 4, but also considering the views of FIG. 5 and referring momentarily back to FIG. 1, the tumbler 68 is rotated about axis 68A by a hydraulic motor 124 acting on a drive wheel or roller 126 which in turn drives a drive belt 128. As shown, the drive belt 128 extends around the outside of the cylindrical drum 68C of the tumbler 68. The drum or cylindrical wall 68C of tumbler 68 is trapped between the plates 78 and 80 and is mounted on four rollers 130 (only two visible in FIG. 5 and only one visible in FIG. 1). Each of the four rollers 130 is mounted upon a shaft 132 which is fixed to one of the two end plates 78 or 80. The rollers at the front end of the machine 10 are not shown in FIG. 1 for ease of illustration. The rollers may be made of rubber or similar material such that the drum 68C may freely rotate about axis 68A with a minimal amount of friction while being supported by two pairs of rollers 130, one pair at the front end mounted to the end plate 80 and another pair mounted to the end plate 78. If desired, the rollers 130 may include lips 130P (FIG. 4 only) to prevent tumbler housing 68C from shifting forwardly or backwardly, although other bearing arrangements could be used.

Recalling that the spikes are deposited in the cleaning chamber 108 by virtue of the plow 102 (refer back momentarily to FIG. 2), the rotation of the tumbler causes the spikes 72A (FIG. 5 only) to be subjected to tumbling action. With momentary reference to FIG. 6, the rubber liner 110 includes a series of cleats 134 which project inwardly from the liner and which increase the tumbling action of the spikes 72A. The rubber liner 110 may be a rubber belt material commonly used for conveyors wherein the cleats 134 are used to minimize slippage of objects carried along the surface of the conveyor. (Indeed, conveyor 54 could be made of such material.) However, the liner 110 is made of one or a series of such pieces of conveyor belt material which are sufficiently wide to extend from the front end wall 116F to the separation wall 114. The conveyor belt material is cut to a length corresponding essentially to the circumference of the inner diameter of the metal (or other rigid material) drum 68C and the material is inserted therein following the stitching or other connection between the two ends so as to form a cylinder of the belt material with the cleats 134 facing inwardly.

When the spikes 72A have become sufficiently numerous that they pass over or overflow the separation wall 114, they will pass through the hole 114H into the discharge chamber 112. Since the spikes are deposited in the cleaning chamber 108 adjacent to the front wall 116F, any spike which passes over the separation wall 114 will have been subjected to a substantial amount of tumbling action to clean off dirt or other debris from the spike.

Spikes which fall into the discharge chamber 112 will be picked up by one of the four vanes 136 and carried upward. With reference now also to FIG. 7, the spike 72C is shown being carried upward on one of the vanes 136. As shown in the drawing, the vanes 136 are not radial to the central axis 68A. Instead, they are slightly inclined relative to the radial direction such that the spikes such as 72C will not slide off of the vanes 136 until a particular vane is sufficiently high such that the spike will fall onto conveyor belt 54, this spike being carried out of the exit port 122 by virtue of the conveyor belt 54. It should be appreciated that the vanes 136 together with a portion of the conveyor belt 54 serve as a discharge means to discharge spikes automatically from the tumbler 68 after the spikes have been cleaned.

Continuing to view FIG. 7, the entrance port 120 is shown as rectangular and includes a series of fabric, rubber or other material strips 138 which extend downwardly from the top of port 120 to the upper run 70U of the conveyor belt 54. It will be appreciated that only the upper run 70U of the conveyor belt 54 is shown in FIG. 7 and the support tube 74 and its siderails 82 are also not shown for ease of illustration. The strips 138 (only two of which are shown) would extend completely across the entrance port 120 so as to minimize the escape of dust from inside the tumbler 68. The strips 138 essentially form a curtain with vertical slits extending therethrough such that spikes may freely move under them. A spike 72D is shown on the upper run 70U of conveyor 54 in FIG. 7, this corresponding to a spike entering through the entrance port 120.

With reference now primarily to FIG. 5, the exit port 122 is shown as a rectangular hole in the end plate 78. The hole is generally structured similar to the entrance port 120 and includes a series of strips 140 (only two of which are shown) which would extend completely across the width of the exit port 122 and be constructed and function in the same manner as the strips 138 at the port 120. FIG. 5 is somewhat simplified in that again only the upper run 70U of the conveyor 54 is shown. The lower run 70L, support tube 74, and siderails 82 have been deleted from FIG. 5 to avoid overcomplicating the center of that figure. However, it will be appreciated that if those other components were illustrated in FIG. 5, the port 122 would be essentially filled such that objects could only enter or exit the port 122 by way of the space between the upper run 70U and the top edge of the port 122. (It should be appreciated that the entrance port 120 is the same such that objects can only enter between the upper run of the conveyor and the top edge of the entrance port.) Since both the entrance port 120 and exit port 122 are substantially closed off from the outside by way of the strips 138 and 140, the escape of dust from inside the tumbler will be somewhat lessened. Of course, some dust may still escape especially when one of the spikes has momentarily displaced portions of the flexible strips 138 or 140. Spikes which have been cleaned by the tumbler 68 and which pass out of the exit port 122 (FIG. 5) pass along the conveyor headed towards the motor 58 (referring back now to FIG. 1). Since the conveyor passes right next to the operator seat 25, the operator who is controlling the propulsion of the machine 10 may observe the spikes passing along the conveyor in front of him. If a particular spike is seen to be defective, the operator sitting at seat 25 can easily pull it off the conveyor belt and put it in a keg or barrel (not shown) for defective spikes. The defective spikes may be discarded or recycled for scrap metal. Satisfactory spikes which pass in front of the operator at seat 25 may simply be allowed to drop off the edge of the conveyor 54 adjacent the motor 58 so that they fall into a keg 142. When the keg 142 is filled, another keg may be placed in position to catch cleaned and reusable spikes coming off the end of the conveyor belt. If desired, the spikes together with the keg 142 may be moved by way of an optional crane such as crane 28. An optional rack (not shown) for holding kegs could be constructed on the side of the machine by having "hat rack" type hooks mounted on an upstanding frame of connected vertical and horizontal members.

It should be emphasized that the machine 10 can pick up spikes, convey them to a tumbler for cleaning, clean the spikes, discharge the spikes from the cleaner, and deposit the spikes in a keg such as keg 142 automatically (without the need for a human to take intermediate steps). (As mentioned above, the operator sitting at seat 25 may optionally choose to discard defective spikes.) The machine 10 may work as part of a tie gang and the operator sitting at seat 25 may simply cause the propulsion of the vehicle 10 down the track while the vehicle automatically picks up and cleans the spikes and discharges them from the tumbler. The operator may sort out defective spikes, but need not normally transfer spikes from a pickup mechanism to a cleaning mechanism, load a cleaning mechanism, unload a cleaning mechanism, or take other time consuming steps.

Although various preferred constructions have been described herein, it is to be understood that these are for illustrative purposes only. Various modifications and adaptations will be readily apparent to those of skill in the art. Accordingly, the scope of the present invention should be determined by reference to the claims appended hereto.

What is claimed is:

1. A spike cleaning apparatus comprising:

(a) a tumbler having a cleaning chamber therein;

(b) a motor means operatively connected to move said tumbler and for cleaning spikes by tumbling action of spikes within said cleaning chamber; and (c) a vehicle frame having rail engaging wheels mounted thereto and operable to move along a railroad track, said tumbler mounted to said vehicle frame; and further comprising input means to automatically pick up spikes and feed spikes continuously into said tumbler while it is tumbling and means to automatically discharge cleaned spikes from said tumbler while said tumbler is tumbling.

2. A spike cleaning apparatus comprising:

(a) a tumbler having a cleaning chamber therein;

(b) a motor means operatively connected to move said tumbler and for cleaning spikes by tumbling action of spikes within said cleaning chamber; and (c) a vehicle frame having rail engaging wheels mounted thereto and operable to move along a railroad track, said tumbler mounted to said vehicle frame; and wherein said tumbler is a continuous tumbler operable to receive spikes continuously while it is tumbling and operable to automatically discharge cleaned spikes while it is tumbling, and further comprising:

a conveyor extending from outside said tumbler to within said tumbler; and a remover operable to remove spikes from said conveyor and cause the spikes to become disposed in a portion of said cleaning chamber for cleaning therein; and wherein said apparatus is operable to automatically remove spikes from said tumbler by way of said conveyor after cleaning of spikes.

3. The spike cleaning apparatus of claim 2 wherein said conveyor carries spikes into said tumbler via an entrance port and out of said tumbler via an exit port and wherein said entrance port and said exit port are at opposite ends of said tumbler.

4. The spike cleaning apparatus of claim 3 wherein said remover is a plow which is disposable in a plowing position to cause spikes to drop off of said conveyor to be cleaned in said cleaning chamber.

5. The spike cleaning apparatus of claim 4 wherein said plow is movable out of said plowing position such that spikes may travel directly through said tumbler without cleaning.

6. The spike cleaning apparatus of claim 3 further comprising a discharge chamber adjacent said exit port, said discharge chamber having at least one vane disposed therein and operable to carry spikes up to a point where the spikes fall onto the conveyor for removal from said tumbler.

7. The spike cleaning apparatus of claim 6 wherein said discharge chamber receives spikes from said cleaning chamber after the spikes in said cleaning chamber have reached a sufficient magnitude to overcome a barrier separating said cleaning chamber and said discharge chamber.

8. The spike cleaning apparatus of claim 2 wherein said conveyor is a conveyor belt and further comprising an input bin and a feed magnetic wheel which is operable to feed spikes automatically from said input bin onto said conveyor.

9. The spike cleaning apparatus of claim 8 wherein said conveyor belt extends around said feed magnetic wheel.

10. The spike cleaning apparatus of claim 8 further comprising a pick up magnetic wheel operable to automatically pick up spikes from a rail bed and automatically feed the spikes to said input bin.

11. The spike cleaning apparatus of claim 1 wherein said input means automatically picks up spikes from a rail bed.

12. The spike cleaning apparatus of claim 1 wherein said cleaning chamber has a resilient liner disposed therein, said resilient liner having inwardly projecting portions to promote tumbling.

13. The spike cleaning apparatus of claim 1 wherein said tumbler rotates 360° about an axis which is within 30° of horizontal.

14. A spike cleaning apparatus comprising:

a tumbler having a cleaning chamber and a discharge chamber at least partially separated by a wall from said cleaning chamber, said tumbler having an entrance port for passage of spikes into said cleaning chamber and an exit port for passage of spikes out of said discharge chamber; and wherein said tumbler is operable to automatically cause spikes to move from said cleaning chamber into said discharge chamber after the spikes have been cleaned.

15. The spike cleaning apparatus of claim 14 wherein the spikes move from said cleaning chamber to said discharge chamber upon reaching a sufficient magnitude to pass over said wall.

16. The spike cleaning apparatus of claim 14 further comprising input means to automatically pick up spikes from a rail bed and automatically feed the spikes into the tumbler.

17. The spike cleaning apparatus of claim 16 wherein said input means includes a pickup magnetic wheel operable to automatically pick up spikes from a rail bed and a conveyor to feed the spikes into said tumbler.

18. The spike cleaning apparatus of claim 14 further comprising discharge means operable to automatically discharge spikes from said discharge chamber during continuous tumbling of other spikes in said cleaning chamber.

19. The spike cleaning apparatus of claim 18 wherein said discharge means includes at least one vane disposed in said discharge chamber and operable to carry spikes upward.

20. The spike cleaning apparatus of claim 19 wherein said discharge means includes means to receive spikes falling loose from said vane and to cause spikes to leave said tumbler.

21. The spike cleaning apparatus of claim 20 wherein said means to receive spikes is a conveyor belt.

22. The spike cleaning apparatus of claim 21 wherein said tumbler rotates 360° about an axis which is within 30° of horizontal and wherein said tumbler is a continuous tumbler operable to receive spikes continuously while it is tumbling and operable to automatically discharge cleaned spikes while it is tumbling.

23. The spike cleaning apparatus of claim 14 further comprising:

a conveyor extending from outside said tumbler to within said tumbler; and wherein said apparatus is operable to automatically remove spikes from said tumbler by way of said conveyor after cleaning of the spikes.

24. The spike cleaning apparatus of claim 23 wherein said conveyor carries spikes into said tumbler via an entrance port and out of said tumbler via an exit port and wherein said entrance port and said exit port are at opposite ends of said tumbler.

25. The spike cleaning apparatus of claim 24 wherein said tumbler rotates 360° about an axis which is within 30° of horizontal, and wherein said conveyor is a conveyor belt, and wherein said tumbler is a continuous tumbler operable to receive spikes continuously while it is tumbling and operable to automatically discharge cleaned spikes while it is tumbling.

26. A spike cleaning apparatus comprising:

(a) a tumbler having a cleaning chamber therein;

(b) a motor means operatively connected to move said tumbler and for cleaning spikes by tumbling action of spikes within said cleaning chamber;

(c) a conveyor extending from outside said tumbler to within said tumbler;

(d) a remover operable to remove spikes from said conveyor and cause the spikes to become disposed in a portion of said cleaning chamber for cleaning therein; and wherein said apparatus is operable to automatically remove spikes from said tumbler by way of said conveyor after cleaning of the spikes.

27. The spike cleaning apparatus of claim 26 wherein said conveyor is a conveyor belt operable to carry spikes into said tumbler via an entrance port and out of said tumbler via an exit port, said entrance port and said exit port being at opposite ends of said tumbler.

28. The spike cleaning apparatus of claim 27 wherein said remover is a plow which is disposable in a plowing position to cause spikes to drop off of said conveyor to be cleaned in said cleaning chamber.

29. The spike cleaning apparatus of claim 28 wherein said plow is movable out of said plowing position such that spikes may travel directly through said tumbler without cleaning.

30. The spike cleaning apparatus of claim 27 wherein said tumbler includes a discharge chamber adjacent said exit port, said discharge chamber having at least one vane disposed therein and operable to carry spikes up to a point where the spikes fall onto the conveyor for removal from said tumbler.

31. The spike cleaning apparatus of claim 30 wherein said discharge chamber receives spikes from said cleaning chamber after the spikes in said cleaning chamber have reached sufficient magnitude to overcome a barrier separating said cleaning chamber and said discharge chamber.

32. The spike cleaning apparatus of claim 27 wherein said tumbler is a continuous tumbler operable to receive spikes continuously while it is tumbling and operable to automatically discharge cleaned spikes while it is tumbling.

33. The spike cleaning apparatus of claim 27 wherein said tumbler rotates 360° about an axis which is within 30° of horizontal, and further comprising:

a vehicle frame having rail engaging wheels mounted thereto and operable to move along a railroad track, said tumbler mounted to said vehicle frame.

34. The spike cleaning apparatus of claim 26 further comprising input means to automatically pick up spikes from a rail bed and automatically feed the spikes into the tumbler.

35. The spike cleaning apparatus of claim 34 wherein said input means includes a pick up magnetic wheel operable to pick up spikes from a rail bed and deposit spikes in an input bin and a feed magnetic wheel operable to feed spikes automatically from said input bin into said conveyor.

36. A cleaning apparatus for metallic articles comprising a tumbler, said tumbler having a housing made of rigid material and a cleaning chamber having inner surfaces, a liner of resilient material covering a substantial portion of said inner surfaces, and a motor means operably connected to move said tumbler for cleaning metallic articles therein, and wherein the cleaning apparatus is a spike cleaning apparatus for cleaning spikes, and further comprising a vehicle frame having rail engaging wheels mounted thereto and said tumbler is mounted on said vehicle frame, and further comprising input means to automatically pick up spikes and feed spikes into said tumbler continuously while said tumbler is tumbling and means to automatically discharge cleaned spikes from said tumbler while said tumbler is tumbling.

37. A cleaning apparatus for metallic articles comprising a tumbler, said tumbler having a housing made of rigid material and a cleaning chamber having inner surfaces, a liner of resilient material covering a substantial portion of said inner surfaces, and a motor means operably connected to move said tumbler for cleaning metallic articles therein, and wherein said tumbler has a discharge chamber at least partially separated by a wall from said cleaning chamber, said tumbler having an entrance port for passage of metallic articles into said cleaning chamber and an exit port for passage of metallic articles out of said discharge chamber; and wherein said tumbler is operable to automatically cause metallic articles to move from said cleaning chamber into said discharge chamber after the metallic articles have been cleaned.

38. A cleaning apparatus for metallic articles comprising a tumbler, said tumbler having a housing made of rigid material and a cleaning chamber having inner surfaces, a liner of resilient material covering a substantial portion of said inner surfaces, and a motor means operably connected to move said tumbler for cleaning metallic articles therein, and further comprising a conveyor extending from outside said tumbler to within said tumbler; a remover operable to remove metallic articles from said conveyor and cause the metallic articles to become disposed in a portion of said cleaning chamber for cleaning therein; and wherein said apparatus is operable to automatically remove metallic articles from said tumbler by way of said conveyor after cleaning of the metallic articles.

* * * * *